United States Patent [19]

Walker

[11] 4,030,587

[45] June 21, 1977

[54] COMPUTER TERMINAL

[76] Inventor: Alexander D. R. Walker, 1200 Dale Ave., Apt. 106, Mountain View, Calif. 94040

[22] Filed: Dec. 8, 1975

[21] Appl. No.: 638,832

Related U.S. Application Data

[63] Continuation of Ser. No. 448,192, March 5, 1974, abandoned.

[52] U.S. Cl. ..... 197/1 R; 197/90; 197/89

[51] Int. Cl.[2] ..... B41J 3/04

[58] Field of Search ..... 197/1 R, 82, 90, 84 R, 197/89; 101/93.04, 93.05; 346/76 R, 139, 141

[56] References Cited

UNITED STATES PATENTS

| | | | |
|---|---|---|---|
| 3,387,081 | 6/1968 | Kleinschmidt et al. | 101/93.04 X |
| 3,495,070 | 2/1970 | Zissen | 346/76 X |
| 3,596,055 | 7/1971 | Elston | 197/1 R X |
| 3,631,512 | 12/1971 | Janning | 346/76 R |
| 3,690,431 | 9/1972 | Howard | 197/1 R |
| 3,710,913 | 1/1973 | Brennan et al. | 101/93.04 X |

FOREIGN PATENTS OR APPLICATIONS

| | | | |
|---|---|---|---|
| 2,161,289 | 11/1971 | France | 197/1 R |

*Primary Examiner*—Ralph T. Rader
*Attorney, Agent, or Firm*—Robert G. Slick

[57] ABSTRACT

A computer terminal including a printer including a heat sensitive sheet across which a thermal head having a vertical column of resistors can move with appropriate electrical energization controlled by a keyboard to effect character printing on the sheet, and also to generate a coded output for transmission to and from a computer at a central station.

3 Claims, 7 Drawing Figures

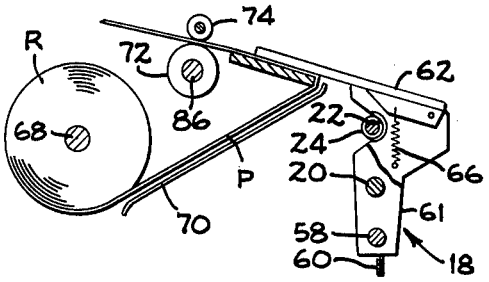
Fig_3
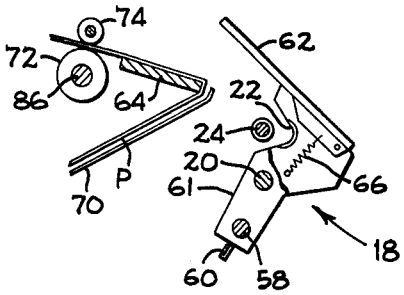
Fig_3A
Fig_4
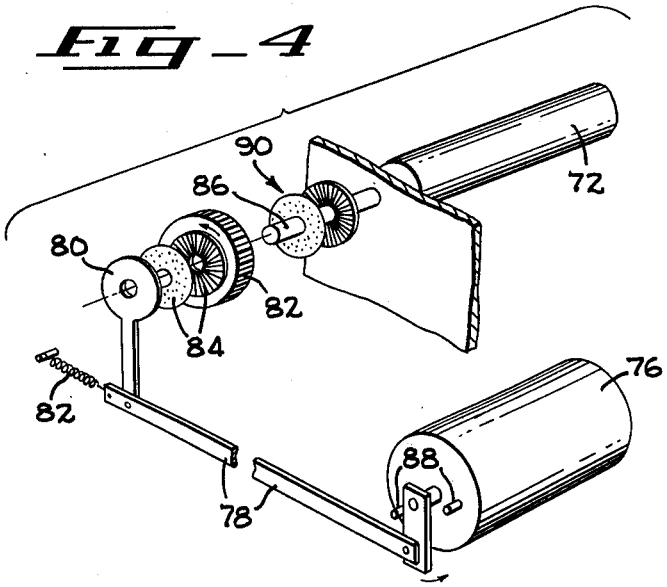
Fig_5
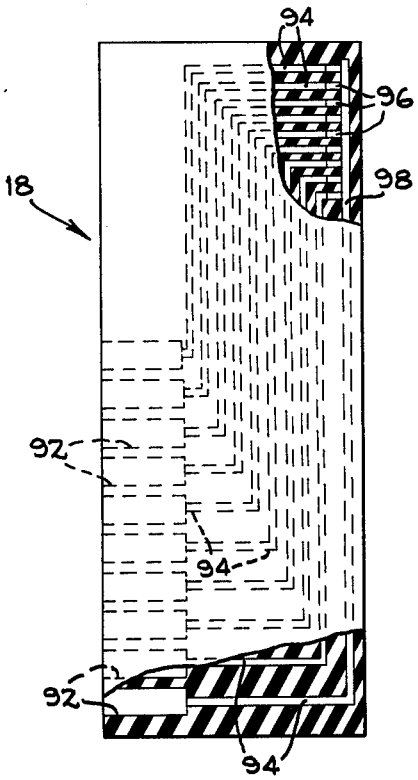
Fig_6
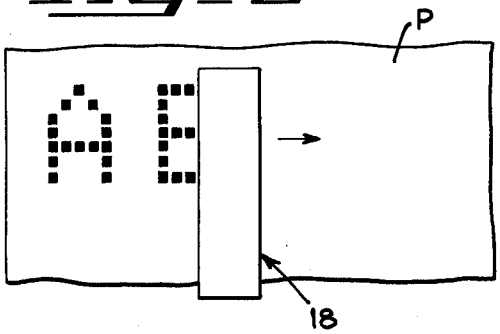

COMPUTER TERMINAL

This is a continuation of application Ser. No. 448,192, filed Mar. 5, 1974, now abandoned.

FIELD OF THE INVENTION

The present invention relates to computers and more particularly to a computer terminal disposed at a remote location from the computer itself and the associated apparatus whereby input data can be delivered to the computer and output data received at such remote location.

BACKGROUND OF THE INVENTION

As is well known, a large number of computers are now available for handling input information or data and of course are capable of handling such data extremely rapidly. As a practical matter, many of the computers now are not fully utilized, and so little in some cases that their installations are barely economically justifiable.

The main reason for minimal usage is the expense of existent computer terminals which is such that their wide general use is economically prohibitive. For example, the total cost of 30 computer terminals for educational purposes in a classroom currently far exceeds the cost of the computer itself. To a large extent this excessive cost is due to the expense of the printing mechanism, it being generally accepted that printed input and output data are a practical necessity. Conventional impact printing such as is performed by electric or manual typewriters obviously requires a relatively expensive mechanism and is high in its operating energy requirements. Electrostatic varieties of printing require high voltages, and thermal techniques employing a heat-sensitive paper utilize thermal heads with transistors having a relatively high thermal mass so as to require considerable amounts of energy to heat up the necessary printing temperature of approximately 170° Centigrade, and at the same time having high thermal inertia which limits the printing speed. Fabrication of such a head is currently expensive as well.

Further reasons for minimal usage are: the terminals have to be connected directly by special lines or indirectly via the phone line to the computer. In the former case, accessibility to the computer is limited to permanent installations close to the computer, while in the latter case, the bandwidth of the phone line limits the printing speed to 30 characters/sec. and requires the telephonic link, and with current models the mains (115 volts AC), to be also present.

SUMMARY OF THE PRESENT INVENTION

Accordingly, it is the general objective of the present invention to provide a low-cost computer terminal employing a novel printing mechanism which is not only cost but is capable of operation at relatively low energy so that the unit can be battery powered and portable, and which also has an associated low cost apparatus for performing other associated functions, including a remote transceiver for handling delivery and receipt of information to and form a transceiver associated with a computer at a central station, but also including options to 1) communicate via phone line, 2) communicate directly to the computer.

This objective is achieved by a computer terminal whose overall size is less than that of the average portable typewriter, which is relatively light, and furthermore is preferably battery-powered, thus enabling complete and ready portability. The terminal includes a keyboard having a plurality of manually-depressible keys representative of selected alphanumeric characters and desired functional keys dependent upon the particular usage of the terminal so that the desired input data can be easily introduced by the operator. If a particular key is depressed, electrical contact is made initially to actuate the appropriate circuit in a standard keyboard decoder which preferably produces a unique binary code related to the particular character, and for practical purposes will take the form of the standard ASCII code. The binary code information is optionally connected to modulate the carrier frequency of a small FM transceiver which will radiate the modulated electromagnetic energy for transmission to a transceiver at a central station and associated with a computer which accordingly receives the input data. As a practical matter, a transceiver having a power rating of no more than one watt is all that is required for transmission of the energy up to a range of 50 miles. Optionally, the terminal can be connected to the phone line or directly to the computer.

The resultant output data generated by the computer is re-radiated from the central transceiver to the remote transceiver in the computer terminal and, like the input data, is recorded at the terminal as will be explained hereinafter.

When either the individual key in the keyboard is depressed or a data element is returned from the central computer, a pulse of direct current energy is delivered to a small DC motor to instigate rotation thereof and this motor in turn drives a screw rod which engages a thermal printing head for imparting motion thereto a predetermined distance across an adjacent sheet of thermal-sensitive paper. Preferably, a second shorter pulse is delivered to another DC motor or a solenoid which is interconnected with the rotating screw rod so as to control the precise amount of revolution thereof and the threads on the screw rod are of a pitch such that the thermal printing head will advance across the heat-sensitive paper the equivalent of one character to be printed thereon, for example the letter *a*.

In a preferred embodiment of the invention, the thermal head includes a single vertical column with nine slightly separated thin flim resistors which are individually supplied with current depending on the selected character to be printed sufficient to heat the resistors to 170° Centigrade, thus to effect a color change in the adjacent sheet of heat-sensitive paper, thus to instigate the printing operation. As the thermal head advances across the paper through the revolution of the driving screw rod, a commutator associated with such rod is arranged to make successive exitation of the circuits which energize the resistors to ultimately complete in a series of seven steps a dot matrix for the one particular character. While we are here mentioning an array or matrix for presentation of a single character that is 7×9 dots, a 5×7 array or any other requisite for a particular representation can obviously be envisioned.

The thermal head is preferably slidably and pivotally supported on a guide rod and is spring urged into contact with the screw rod for advance thereof across the paper by a simple spring, and after a complete line of printing has been achieved, simple depression of the appropriate functional key on the keyboard will energize another electric motor or solenoid to effect momentary pivoting of the head away from its driving contact with the screw rod and also printing contact with the paper, to enable a simple mechanical spring to withdraw the head to the left side of the paper preparatory to an additional line of printing.

The heat-sensitive paper, preferably in the form of a standard roll or paper, passes from such roll over a plate or platen whereon it is engaged by the thermal head and makes contact therebeyond with a drive roller which can be advanced by the simple actuation of yet another DC motor a distance sufficient to ready for receipt of the next line of printing.

The DC drive motors or solenoids are small, low-cost units and require but slight power input so that the total power required to energize the transceiver, energize the thermal head and the various mechanical motions, as briefly discussed hereinabove, is relatively small and lends itself to operation with an included battery.

BRIEF DESCRIPTION OF THE DRAWINGS

The stated objective of the invention and the manner in which it is achieved as summarized hereinabove will be more readily understood by reference to the following detailed description of the exemplary apparatus shown in the accompanying drawings wherein:

FIG. 3 is a fragmentary cross-sectional view taken along line 3—3 of FIG. 2 illustrating the relationship of the thermal head and the associated heat-sensitive paper mounting arrangement.

FIG. 3-A is a fragmentary cross-sectional view indicating retraction of the thermal head from contact with the paper, FIG. 4 is an exploded fragmentary perspective view illustrating the drive mechanism for the paper advance, FIG. 5 is an elevational view of the paper contacting face of the thermal head, FIG. 6 is an operational showing of the printing of characters on the paper by the head.

DETAILED DESCRIPTION OF THE EXEMPLARY EMBODIMENT OF THE INVENTION

Figure 1:
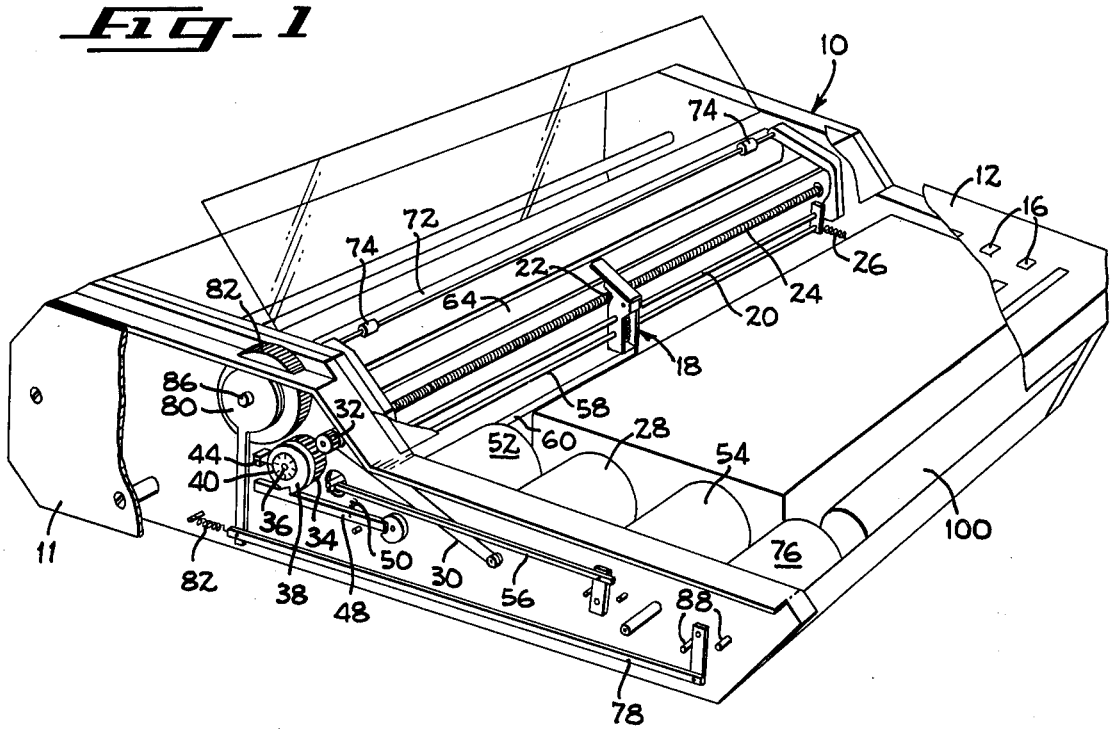
FIG. 1 is a perspective view of a computer terminal embodying the present invention, portions of the housing being removed to illustrate interior details of construction.

With initial reference to FIG. 1, the computer terminal embodying the invention can be seen as having the general shape and configuration of a small poartable typewriter, and for handling standard size heat-sensitive paper with a width of 8½ inches, the entire unit can have horizontal dimensions of 10 inches by 9 inches, and a height of approximately 3 inches. The main housing 10 can have a bottom and upstanding flanged end plates that are composed preferably of a unitary plastic material and a keyboard 12, shown in FIG. 1 as partially broken away, is received between the end plates but can be removed when access to the interior electrical and mechanical mechanisms is desired. In turn, an end cap 14 at the left end of the housing 10, also shown as partially broken away, can be removed by loosening several simple screws, thus providing complete access to all operating elements of the unit.

The keyboard 12 can also constitute a flat plastic plate that receives a number of depressible keys 16 with suitable alphanumeric or other visual indicia on their upper surfaces. When each individual key 16 is depressed, a unique electrical circuit is energized, as will be explained in detail hereinafter, and, preferably, the keyboard arrangement takes the form of that shown and described in detail in my prior U.S. patent application Ser. No. 368,980, to which reference is made for details of its actuation and construction.

Figure 2:
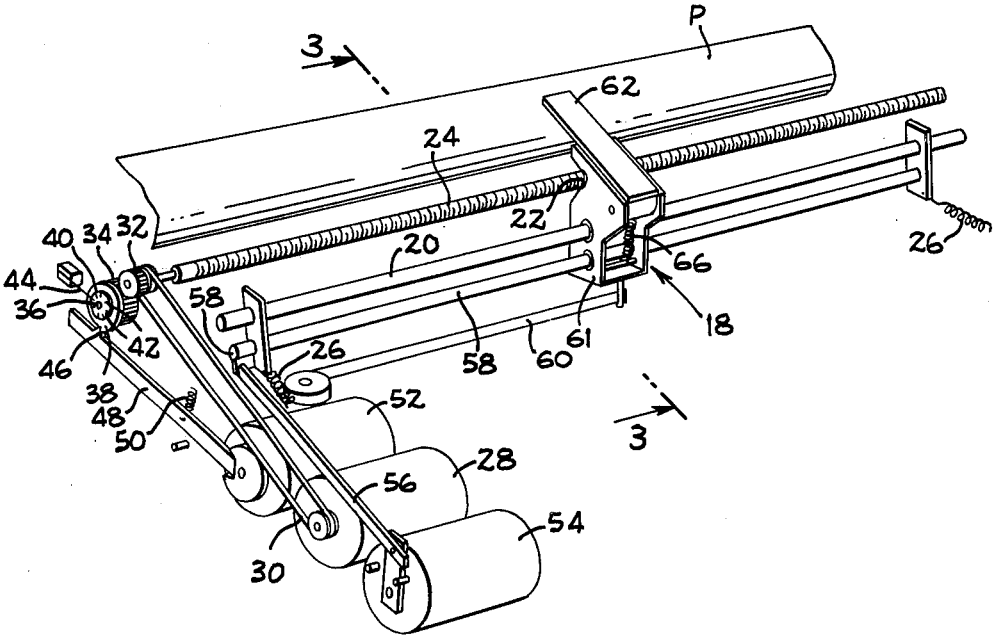
FIG. 2 is a fragmentary perspective view of a portion of the FIG. 1 unit including the thermal head and its associated drive mechanism.

With continued reference to FIG. 1, and additional detailed reference to FIG. 2, depression of any one of the alphanumeric keys 16 will instigate motion of a thermal head or print head assembly 18 across the exposed adjacent portion of heat-sensitive paper P. More particularly, the thermal head 18 is pivotally and slidably supported on a guide rod 20 that spans the space between the end plates of the housing 10 and includes an arcuate threaded portion 22 adapted to engage a screw rod 24 supported for rotation in suitable bearings in the end plates. Accordingly, when the screw rod 24 is rotated, the thermal head 18 will move transversely across the unit and accordingly across the paper P against which the upper projecting end of the head is urged, normally by a simple spring 26. The pitch of the mating threads on the thermal head 18 and the contacting screw rod 24 is such that an integral number of revolutions (e.g., 2 revolutions) of the screw rod will advance the thermal head a distance along the paper P equivalent to one printed character.

In order to advance the head the space of one character, each depression of a key 16 on the keyboard 12 is arranged electrically to supply a pulse of DC energy to a small DC electric motor 28 mounted from the one end plate which, in turn, through a small pulley-belt connection 30, is connected to the screw rod 24, thus to energize the desired advance of the thermal head 18. A constant speed of motion of the thermal head 18 across the paper can be readily approximated by controlling the energy supplied to the motor for each character step. The end of the screw rod 24 also mounts a small gear 32 which engages an adjacent larger gear 34 mounted on a stub shaft 36 that also carries a notched disc 38 and commutator 40 having a desired number of contacts 42 on its surface, which are, in turn, engaged by an associated electrical wiper or brush 44 which is electrically connected to the actuating circuits for the electrical energization and heating of the elements of the thermal head, as will be explained hereinafter. The notched disc 38 is normally held against rotation by a catch 46 on an arm 48 that is pivotally supported and urged into its catching position by a small spring 50 whose force however is overcome momentarily by a short DC pulse delivered to a second DC electric motor 52 mounted on the end plate of the unit which is delivered to this motor simultaneously with the pulse to the screw rod drive motor 28, thus to release the catch 46 momentarily whereupon it will ride on the surface of the notched disc 38 until a single revolution thereof has been completed, at which time further rotation will be stopped. In this fashion, a precise amount of rotation of the screw rod 24 can be achieved without the employment of expensive stepping motors or analogous devices, and it is error correcting. It should be mentioned that the second DC motor 52 actually functions in a fashion equivalent to a solenoid and such substitution for energization of the catch arm 48 will be obvious to those skilled in the art. By choice of the gear ratio, one turn of the commutator gear 34 will rotate the screw rod gear 32 a precise multiple of one revolution (e.g., 2 revolutions).

After the thermal head 18 has been advanced by repeated revolutions of the screw rod 24 to the right side of the associated paper P, thus complete a line of printing, a head return key on the keyboard 12 can be depressed so as to energize a third DC motor 54 also mounted on the end plate which is connected by a suitable pivoted linkage 56 to an angle rod 58 that slidably extends through an opening in the thermal head 18 in parallelism to its main guide rod 20 to effect pivotal motion of the thermal head 18 away from contact with the paper, as best shwon in FIG. 3-A, and at the same time disengaging the thermal head 18 from the driving screw rod 24, whereupon a constant tension return spring 60 connected between the thermal head 18 and the end plate will return the thermal head 18 the full distance across the paper preparatory to further printing on the next line on the paper. Re-engagement of the thermal head 18 with the screw rod 24 is automatically assured because the screw rod, having one entry point to the head, is set up in 1—1 correspondence with the stopping point at each character step of the head.

With additional reference to FIG. 3, it will be seen that the thermal head 18 is composed of a base portion 60 which slides along the guide rod 20 and incorporates the mentioned open threaded portion 22 that contacts the screw rod 24, and a pivoted head portion 62 whose extremity is urged resiliently into contact with the paper P on a backing plate 64 by a small spring 66 which can be adjusted to asure the desired contact between the head and the paper during a printing operation.

The paper P is fed from a suitable rotatively supported roll R on a shaft 68 which spans the space between the end plates of the housing 10 and then passes across a paper guide 70 and over the described backing plate 64 whereat the thermal head 18 makes contact therewith. The paper P then passes over a drive roller 72 against which it is urged into frictional contact by an adjacent idler roller 75, thence to emerge into a visually accesible position for the operator.

In order to energize the paper drive roller 72 a single line at a time, an additional key on the keyboard 12 is arranged to supply a pulse to a fourth DC motor 76 that is connected by pivoted linkage 78 to a drive disc 80 that is in turn connected to a paper advance wheel 82 by a one-way clutch 84, as best shown in FIG. 4, all on the drive roller shaft 86. After the paper P has been advanced a single line, and the motor 76 has been de-energized, a coil spring 82 also connected to the linkage 78 returns the drive disc 80 to its original position. Preferably, to assure precision of the paper drive roller advance, small stops 88 are mounted on the side of the drive motor 76 to limit the amount of rotation upon the occasion of each energization. Preferably, a second one-way clutch assembly 90 is mounted on the drive roller shaft 86 to positively preclude any return rotation of the drive roller as a result of the described spring actuation. The paper advance wheel 82 has its exterior periphery exposed through the upper portion of the housing 10 so that manual advance of the paper, when desired, is readily achieved.

The paper-contacting face of the thermal head 18 is shown greatly enlarged in FIG. 5 and includes suitable connector sockets 92 which are electrically connected to gold leads 94 deposited in a thin layer on a substrate of ceramic, glass or other insulating material of suitable thickness, the gold leads beng individually connected at their extremities to a vertical column of this film resistors 96 having a common ground lead 98 and which can be composed of chromium, molybdenum or other materials with predetermined resistance values so that each can be heated by a supply of current to the required printing temperature of 170° C in a period between two and four msecs. Specifically, with a 5-volt battery source 100, as shown in FIG. 1, the layers of these materials will have a thickness to provide a resistance value of approximately 20 ohms. It can therefore be visualized that the physical mass of the thin film resistors 96 is very slight and their cool-down time will also be in the range of 2 to 4 msecs, particularly since the head is in contact with the paper P to act as a heat sink. The cooling is further accelerated by the head movement. If, as illustrated, a vertical column of nine resistors 96 is formed on the head 18, the preferred operation is to produce a 7×9 dot matrix or array for each character to be printed and a printing rate of approximately 30 characters per second is therefore permitted, this being more than adequate for substantially all applications. It will be recognized that with some additional complexity, two or more vertical resistor columns can be placed on the head with attendant increase in the printing rate. Fabrication of the described head is relatively inexpensive.

Experimentation has determined that not only is the printing rate fast but it requires but slight power of approximately 3 to 5 watt msecs to develop one printed dot so that the average heating energy required per character would be from 30 to 60 watt msecs. A rather extensive battery life is therefore assured.

When a particular key is depressed and advance of the thermal head 18 across the paper for a distance equivalent to one character is instigated, the commutator contact establishes the appropriate energization of the vertical column of resistors 96 in each of seven positions and the resultant dot matrix for individual characters will appear as shown in FIG. 6, this particular dot matrix being capable of representing all alphanumeric characters in a very legible fashion. Legibility of the character is enhanced by allowing the horizontally generated lines to "smear" somewhat during printing, giving the appearance of a continuous line.

Since the thermal head 18 remains in contact with the paper during its advance thereacross, preferably a thin layer of wear resistant material is applied over its contacting surface, a layer of 100–200 angstroms of sapphire, aluminum oxide or the like being exemplary.

The overall operation of the apparatus can best be explained by reference to the diagram of FIG. 7. When a key 16 is depressed, a conventional decoder 102 is actuated to generate the unique binary code data (ASCII code) that is then scanned to modulate the carrier wave in an FM transceiver 104 whose radiated energy is received at a transceiver 106 connected to the computer 108 at the central station. The data is reradiated to the local transceiver 104 and is transferred through the decoder 102 to a memory unit 110 which stores the data for subsequent energization of drivers 112 connected to a standard pulse generator 116 for the individual resistors 96 on the column of the thermal head 18. The pulses from a pulser unit 118 for control of the head advance and head stopping motors are also instigated by a signal from the decoder 102, thus to advance the head and effect rotation of the commutator 40 which, through a suitable counter 114, controls the delivery of energy from the memory unit 110 to the drivers 112 for the head resistors 96.

Figure 7:
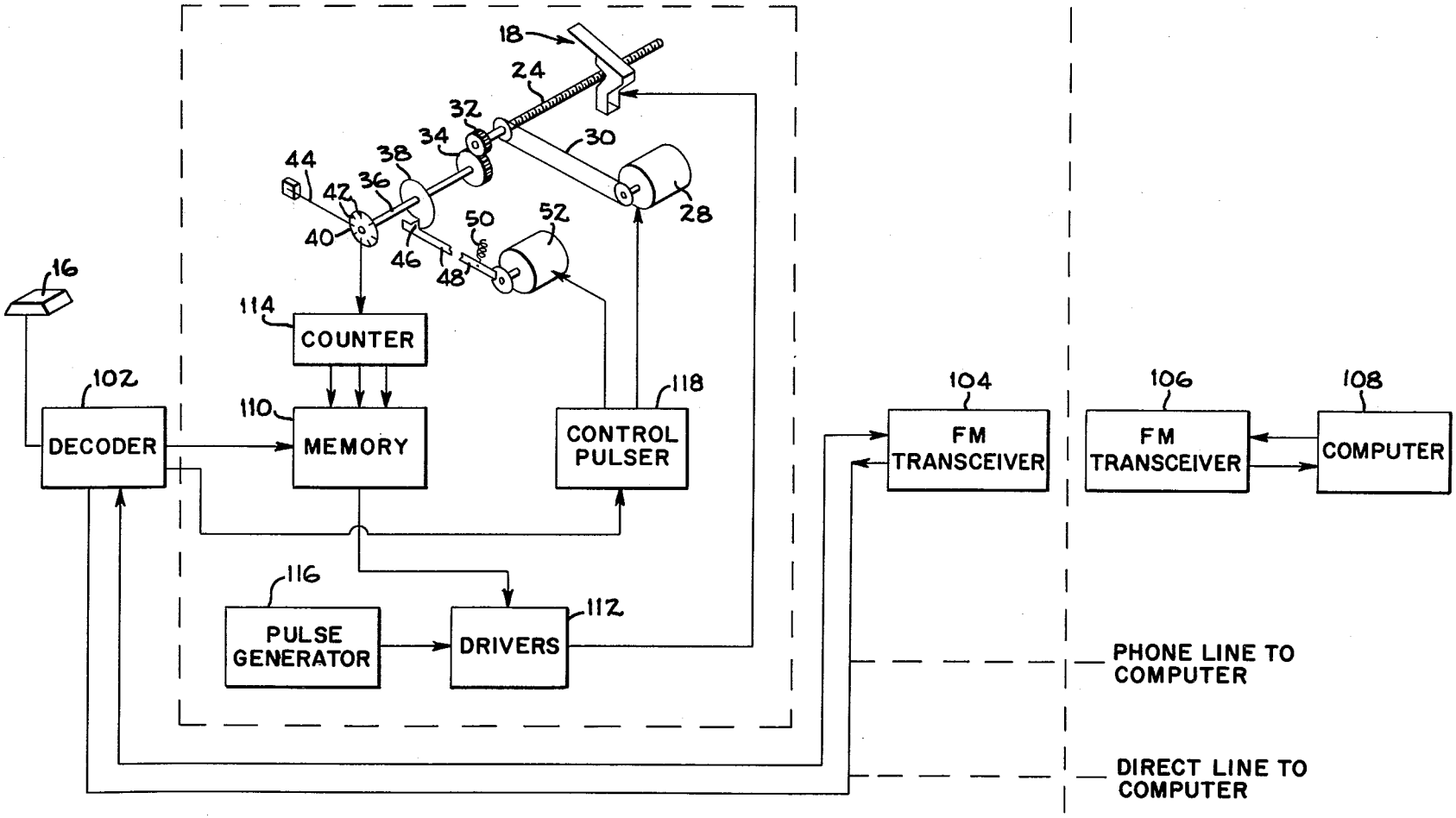
FIG. 7 is an overall diagrammatic view of the system indicating the inter-relationship of the mechanical and electrical elements thereof.

As indicated in FIG. 7, optional connections can be made directly to a computer or indirectly through phone lines thereto.

It will be obvious that many modifications and/or alterations can be made in the exemplary structure described herein without departing from the spirit of the invention, and consequently the scope of the invention is to be indicated only by reference to the appended claims.

What is claimed is:

1. A dot matrix printer of the kind comprising a print head assembly for printing at least one vertical column in a character having a width of a plurality of columns, a rotatable lead screw, a lead screw follower mounted on the print head assembly and selectively engageable with the lead screw for causing the print head assembly to move along the lead screw when the lead screw is rotated and the lead screw follower is engaged therewith, lead screw motor means connected with the lead screw for rotating the lead screw to drive the print head assembly across a printing surface in a printing direction away from an initial location in a sequence of movements of one full character width each, control means connected with the motor means to operate the motor means to rotate the lead screw in response to a signal supplied thereto representative of a character to be printed, return spring means connected with the print head assembly for moving the print head assembly in a reverse direction when the lead screw follower is disengaged from the lead screw to position the print head assembly at the initial location to begin a new line of printing, rotatable commutator means connected to be driven synchronously with the lead screw and in response to operation of said motor means, for generating a series of column signals only during a printing cycle indicative of individual column positions of a character each time the print head assembly is driven to move through one character-width movement in the printing direction, print head driver means operatively connected with the commutator means and the print head and responsive to said column signals from the synchronously driven commutator means for actuating the print head at a plurality of successive column positions to print a character as the print head assembly traverses one character-width movement, without interrupting such movement, and rotary detent means coupled to the lead screw, actuatable between a normal condition precluding rotation of the lead screw and an actuated condition permitting rotation of the lead screw through an angular displacement corresponding to movement of the print head assembly through a single character-width movement in the printing direction; and detent actuator means responsive to an electrical signal, for actuating the detent means to its actuated condition.

2. A dot matrix printer according to claim 1, the print head assembly being pivotally movable between a print position in which the print head engages the printing surface and the lead screw follower engages the lead screw, and a release position in which the print head is separated from the print surface and the lead screw follower is disengaged from the lead screw; resilient print head bias means for normally maintaining the print head in its print position; return actuation means for moving the print head asembly to its release position, against the print head bias means, and thereby allow the print head assembly to return to its initial location.

3. A dot matrix printer according to claim 1, having detent bias means biasing the detent means to its normal condition.

* * * * *